US009142916B2

(12) United States Patent
Allgood et al.

(10) Patent No.: US 9,142,916 B2
(45) Date of Patent: Sep. 22, 2015

(54) CONNECTOR ASSEMBLY WITH RECEPTACLE CARRIERS

(71) Applicant: TYCO ELECTRONICS CORPORATION, Berwyn, PA (US)

(72) Inventors: Christopher Lee Allgood, Clemmons, NC (US); John Raymond Shuey, Mechanicsburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 274 days.

(21) Appl. No.: 13/832,949

(22) Filed: Mar. 15, 2013

(65) Prior Publication Data

US 2014/0273566 A1 Sep. 18, 2014

(51) Int. Cl.

| | |
|---|---|
| ***H01R 13/62*** | (2006.01) |
| ***H01R 13/629*** | (2006.01) |
| ***H01R 13/516*** | (2006.01) |

(52) U.S. Cl.

CPC ..... *H01R 13/62944* (2013.01); *H01R 13/516* (2013.01)

(58) Field of Classification Search

CPC ..... H01R 13/633; H01R 13/635; H01R 13/62938; H01R 13/637; H01R 13/62933

USPC ..... 439/152–160, 372

See application file for complete search history.

(56) References Cited

U.S. PATENT DOCUMENTS

| | | | | |
|---|---|---|---|---|
| 5,322,448 | A | 6/1994 | Hahn | |
| 5,833,484 | A | 11/1998 | Post et al. | |
| 6,126,494 | A * | 10/2000 | Fuchs et al. | 439/835 |
| 6,247,966 | B1 * | 6/2001 | Klein et al. | 439/595 |
| 6,413,105 | B2 * | 7/2002 | Noro et al. | 439/157 |
| 6,736,655 | B2 | 5/2004 | Martin et al. | |
| 7,175,451 | B2 * | 2/2007 | Shuey | 439/157 |
| 7,396,241 | B2 * | 7/2008 | Matsuura et al. | 439/157 |
| 7,435,113 | B2 * | 10/2008 | Cheng et al. | 439/157 |
| 7,445,475 | B2 | 11/2008 | Tajiri et al. | |
| 7,563,114 | B2 * | 7/2009 | Patterson | 439/157 |
| 7,611,365 | B1 | 11/2009 | Ng et al. | |
| 7,698,810 | B2 * | 4/2010 | Huss, Jr. | 29/764 |
| 8,057,245 | B2 * | 11/2011 | Sakamaki et al. | 439/157 |
| 8,197,271 | B2 * | 6/2012 | Kobayashi et al. | 439/157 |
| 8,221,142 | B2 * | 7/2012 | Sakamaki et al. | 439/157 |
| 8,235,742 | B2 * | 8/2012 | Komiyama et al. | 439/347 |
| 2007/0004274 | A1 | 1/2007 | Tabata et al. | |
| 2007/0218729 | A1 | 9/2007 | Cheng et al. | |
| 2009/0246992 | A1 | 10/2009 | Martin | |
| 2010/0178791 | A1 | 7/2010 | Komiyama et al. | |

* cited by examiner

FOREIGN PATENT DOCUMENTS

DE 8714016 U 11/1987

OTHER PUBLICATIONS

International Search Report, International Application No. PCT/US2014/021467, International Filing Date, Mar. 7, 2014.

*Primary Examiner* — Thanh Tam Le

(57) ABSTRACT

A connector assembly which has a housing and a cover. The housing has a connector mating face and a cover mating face. The cover is removably attached to the housing. The cover has a wire receiving cavity with an opening at the end of the cavity. One or more receptacle carrier receiving cavities extend through respective openings on either side of the housing, thereby allowing one or more receptacle carriers to be inserted into the respective receptacle receiving cavities through the respective openings on either side of the housing. The cover can be positioned on the housing in different orientations.

17 Claims, 4 Drawing Sheets

CONNECTOR ASSEMBLY WITH RECEPTACLE CARRIERS

FIELD OF THE INVENTION

The invention is directed to a connector assembly, and more particularly, to a connector assembly in which receptacle carriers can be inserted from either side, thereby simplifying the installation of the carriers in the assembly.

BACKGROUND OF THE INVENTION

Connector assemblies having a lever are known in the industry. Generally, an electrical connector assembly of this type comprises a plug connector that is matable with a pin header, which has a shroud surrounding an array of printed circuit board pins. A rack and pinion and a lever are used to supply a mechanical advantage when the two electrical connectors are mated or unmated. The rack is located on the plug connector, which typically would include terminals attached to wires. The teeth forming the pinion are located on the lever so that the rack and pinion teeth intermesh as the lever is rotated about a pivot pin. Rotation of the lever mates or unmates the two electrical connectors. Connectors of this type are shown in DE 8714016 U, U.S. Pat. Nos. 5,322,448, 6,247,966 and 6,736,655.

However, the prior art connectors as configured are difficult to manipulate, particularly if a large number of circuits or terminals are involved. Connectors that receive carriers or compounds which house the terminals allow for insertion of the carriers in only one direction. Therefore, as the number of circuits or terminals terminated increase, the carriers can become very long, making insertion of the carrier and wires into the connector very difficult and also making the connectors and the carriers difficult to mold. Additionally, the prior art connectors have openings in covers which allow the wires to be routed or dressed in only one direction. Particularly in compartment with little space, the manipulation of the wires into the correct orientation can be difficult.

Another problem with prior art is that the connectors are generally manufactured with the lever mounted on the housing. As the housing has many shoulders, surfaces and cavities, the manufacture of the housing is made difficult due to the complexity of the mold required to form the housing. Therefore, including additional lever mounting members on the housing further increases the complexity of the mold and the housing.

It is, therefore, desirable to provide a connector assembly which overcomes the disadvantages described, including providing a connector assembly which can easily be manufactured and assembled and which can be used in confined spaces.

SUMMARY OF THE INVENTION

An embodiment is directed to a connector assembly which has a housing and a cover. The housing has a connector mating face and a cover mating face. The cover is removably attached to the housing. The cover has a wire receiving cavity with an opening at the end of the cavity. One or more receptacle carrier receiving cavities extend through respective openings on either side of the housing, thereby allowing one or more receptacle carriers to be inserted into the respective receptacle receiving cavities through the respective openings on either side of the housing. The cover can be positioned on the housing in different orientations.

An embodiment is also directed to a connector assembly which has a housing, receptacle carriers and a cover. The housing has receptacle carrier receiving cavities extending through respective openings on either side of the housing. The housing also has a connector mating face and a cover mating face. The receptacle carriers have terminals inserted therein and are positioned in the receptacle carrier receiving cavities. Each terminal is terminated to a respective wire. The cover extends from and is removably attached to the housing. The cover may be mounted to the housing in different orientations, and is prevented from being removed from the housing in a direction which is perpendicular to a longitudinal axis of the housing.

An embodiment is also directed to a cover for use with a connector assembly. The cover includes a lever mounting member provided thereon. The cover also includes a lever rotatably mounted to the lever mounting member to allow the lever to be rotated between an unmated position and a mated position.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
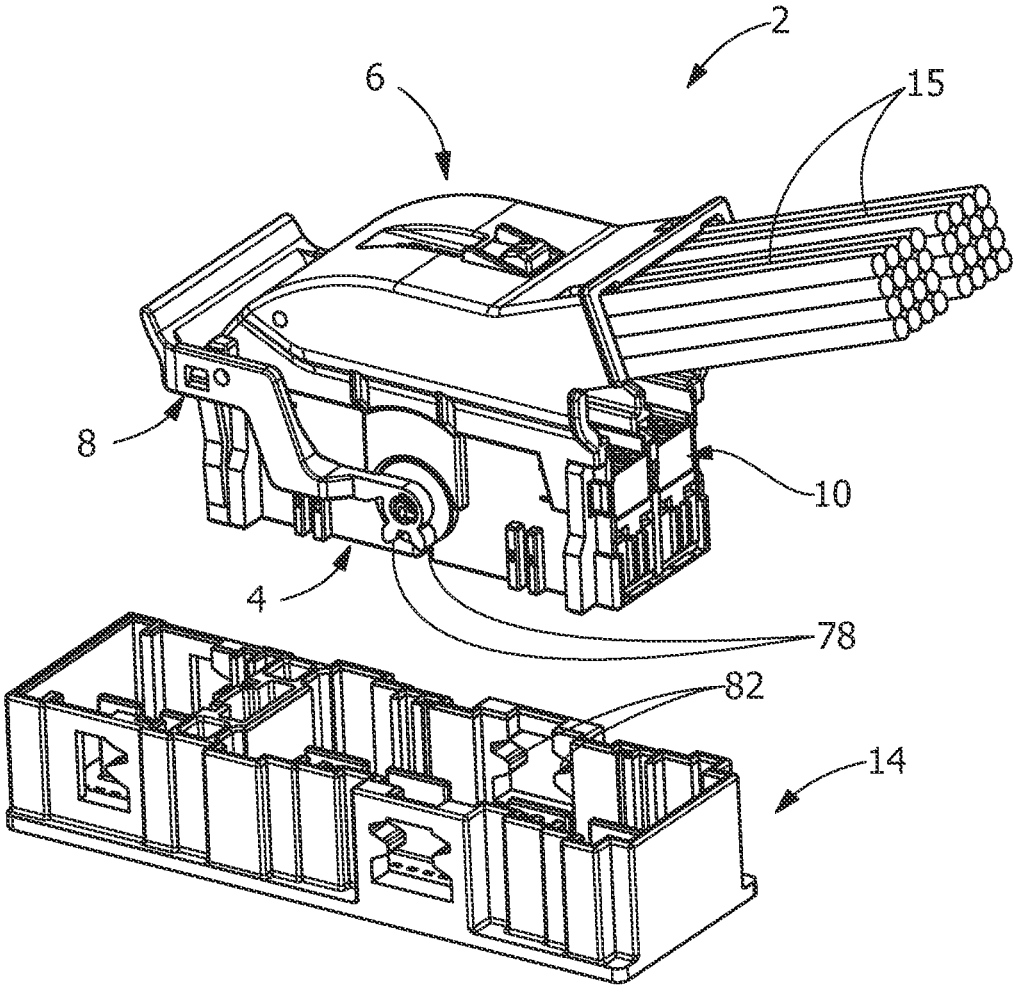
FIG. 1 is a perspective view of an exemplary view of a connector assembly of the present invention shown with terminated wires extending therefrom and prior to mating with an exemplary mating pin header.

FIG. 1 shows and exemplary electrical connector assembly 2 which includes a shield housing 4, a cover 6, a lever 8 and at least one receptacle carrier 10 having terminals 12 (FIG. 5) provided therein. The connector assembly 2 can be mated with a mating connector 14, such as, but not limited to a mating pin header. As will be more fully described below, the lever 8 of the electrical connector assembly 2 employs a rack and pinion mechanism for providing a mechanical advantage to mate and unmate the electrical connector assembly 2 with the mating connector 14. The lever 8 translates rotary motion of the pinion gears into straight line movement of the connector assembly 2 into mating connector 14 along the direction of the rack gears.

Figure 5:
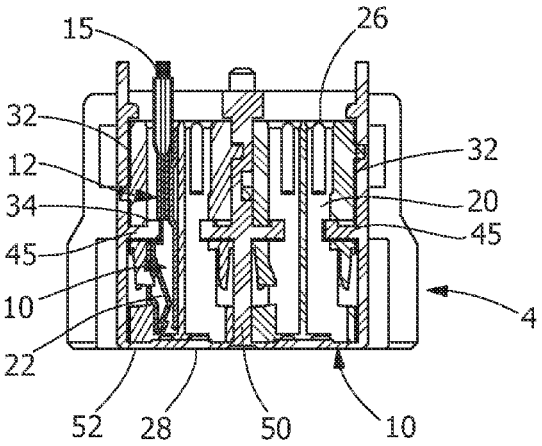
FIG. 5 is a cross-sectional view of the housing of FIG. 2 with receptacle carrier inserted therein.

As shown in FIG. 5, the contacts or terminals 12, employed in electrical connector assembly 2, are crimped to the ends of wires 15 and then inserted into terminal cavities 20 in a respective receptacle carrier 10. These wires are crimped to the terminals in a conventional manner. In the exemplary embodiment, each terminal 12 has a mating socket 22 located at one end. The mating socket 22 includes a spring beam, which is backed up by another beam, in the stamped and formed terminal. A contact or terminal of this type is described in more detail in U.S. Pat. No. 6,475,040, issued Nov. 5, 2002, which is incorporated herein by reference. However, other terminal configurations may be used without departing from the scope of the invention.

Figure 3:
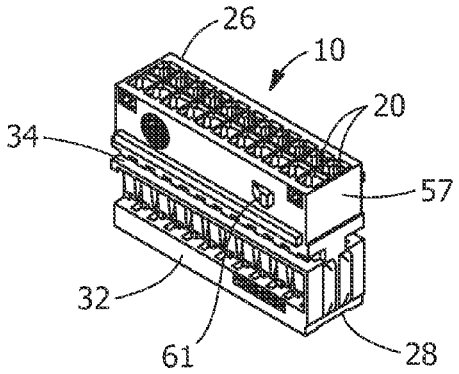
FIG. 3 is a perspective view of an exemplary respective receptacle carrier which is inserted into the housing shown in FIG. 2.

In the exemplary embodiment, the receptacle carrier 10, as shown in FIGS. 3 and 5, has two rows of terminal cavities 20 into which the terminals 12 are inserted through a rear face 26 toward a housing mating face 28. Each cavity 20 extends from the rear face 26 to the mating face 28. The receptacle carrier 10 has a generally rectangular cross section with laterally extending opposed external side faces 32 which are interrupted by slots or grooves 34. A receptacle carrier of this type is described in more detail in U.S. Pat. No. 6,257,966, issued Jun. 19, 2001, which is incorporated herein by reference. However, other receptacle carrier configurations may be used without departing from the scope of the invention.

Figure 2:
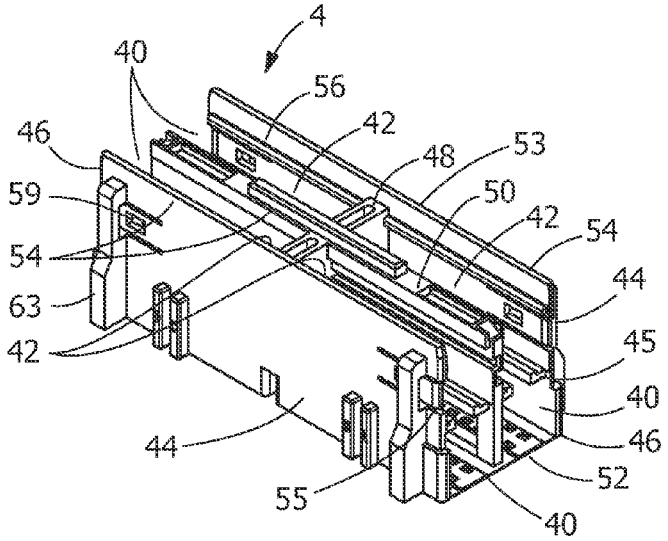
FIG. 2 is a perspective view of an exemplary housing of the connector assembly of FIG. 1, the housing is shown with no receptacle carriers inserted therein.

In the exemplary embodiment shown in FIG. 2, the shield housing 4 has four receptacle receiving cavities 42 provided to house four receptacle carriers 10. The housing 4 has opposed long side walls 44 and opposed short side walls 46. Two openings 40 extend through either short side wall 46 into respective receptacle carrier receiving cavities 42, thereby allowing two receptacle carriers 10 (FIGS. 3 and 5) to be inserted from each side of the housing 4 with one carrier 10 being inserted into each cavity 42. A center wall 48 extends between the opposed long side walls 44. The center wall 48 provides separation between the receptacle carrier receiving cavities 42 proximate one end of the housing 4 and the receptacle carrier receiving cavities 42 provided at the opposite end of the housing 4. A center wall 50 extends between the opposed short side walls 46. The center wall 50 provides separation between the receptacle carrier receiving cavities 42 proximate one side of the housing 4 and the receptacle carrier receiving cavities 42 provided at the opposite side of the housing 4. While four openings 40 and receptacle carrier receiving cavities 42 are provided, other numbers of receptacle carrier receiving cavities and other configurations of the housing 4 can be provided without departing from the scope of the invention.

A bottom wall or connector mating face 52 of the housing 4 has openings or is open to provide a mating face through which the terminals 12 are exposed in order to mate with mating terminals of the mating pin header 14. This aspect of the housing 4 is conventional in nature and will not be described in further detail.

Figure 4:
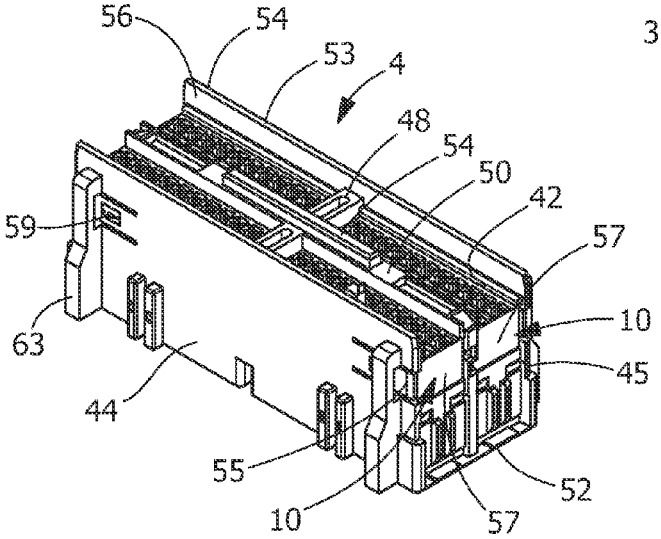
FIG. 4 is a perspective view of the exemplary housing of the connector assembly of FIG. 1, the housing is shown with respective receptacle carriers inserted therein.

As best shown in FIGS. 4 and 5, when all of the terminals 12, with wires 15 crimped thereto, are inserted into the receptacle carrier 10, the receptacle carrier 10 can be inserted through an end opening 40 of a shroud pocket or receptacle carrier receiving cavity 42 of the shield housing 4. As the receptacle carriers are inserted through the opening 40 and into the receptacle carrier receiving cavities 42, shoulders, ridges or projections 45 on the inside of the housing 4 are received in the grooves 34 on the side faces 32 of the receptacle carrier 10. If all of the contacts or terminals 10 are properly inserted into the corresponding housing cavities 20, the projections 45 will be positioned behind the contact mating sockets 22 of all of the terminals 12 and provide a secondary locking of the terminals 12. However, if any of the terminals 12 are not fully inserted, the projection 45 will abut the mating sockets 22 of that partially inserted terminal 12. As the projection cannot be fully inserted behind the mating sockets 22, the projection will extend, preventing complete insertion of receptacle carrier 10 in the shield housing 4. The shield housing 4 and the projections 45 on the interior surfaces of the shield housing 4 thus serve as a terminal position assurance member (TPA) and secondary lock.

As best shown in FIGS. 2 and 4, in order to maintain the receptacle carrier 10 in the housing 4, a resiliently deformable arm 55 on the inside of the housing 4 may engage and end wall 57 on the receptacle carrier 10 to secure the receptacle carrier 10 in the housing 4. In addition to, or alternatively, an opening 59 provided in the deformable arm 55 may engage protrusions 61 (FIG. 3) provided on the side faces 32 of the receptacle carrier to secure the receptacle carrier in the housing 4. Other methods of securing the receptacle carrier 10 in the housing 4 may be used without departing from the scope of the invention.

As shown in FIGS. 2 and 4, rails 54 are provided proximate a cover mating face 53 and extend from proximate the end of walls 44 or center wall 50 which are positioned proximate the top face 56 of the housing 4 which is opposite the bottom wall 50. The rails 54 are positioned to cooperate with the cover 6 to maintain the cover 6 on the housing 4. The configuration of the rails 54 allow the cover 6 to be assembled with a right or left orientation, as will be more fully described.

Figure 8:
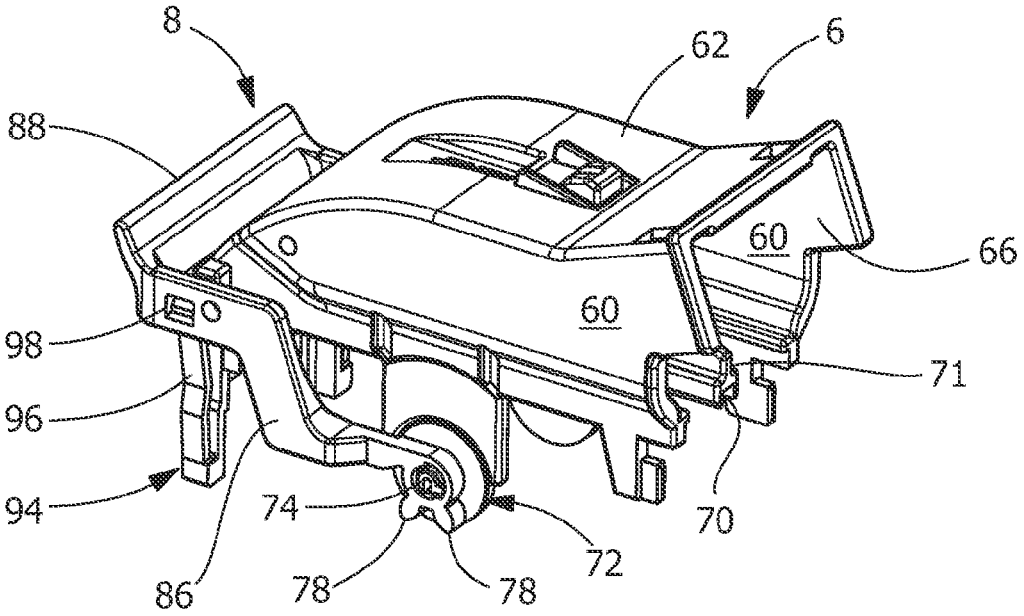
FIG. 8 is a perspective view of the cover of FIG. 6 with a lever mounted thereon, the lever is shown in an unmated position.
Figure 9:
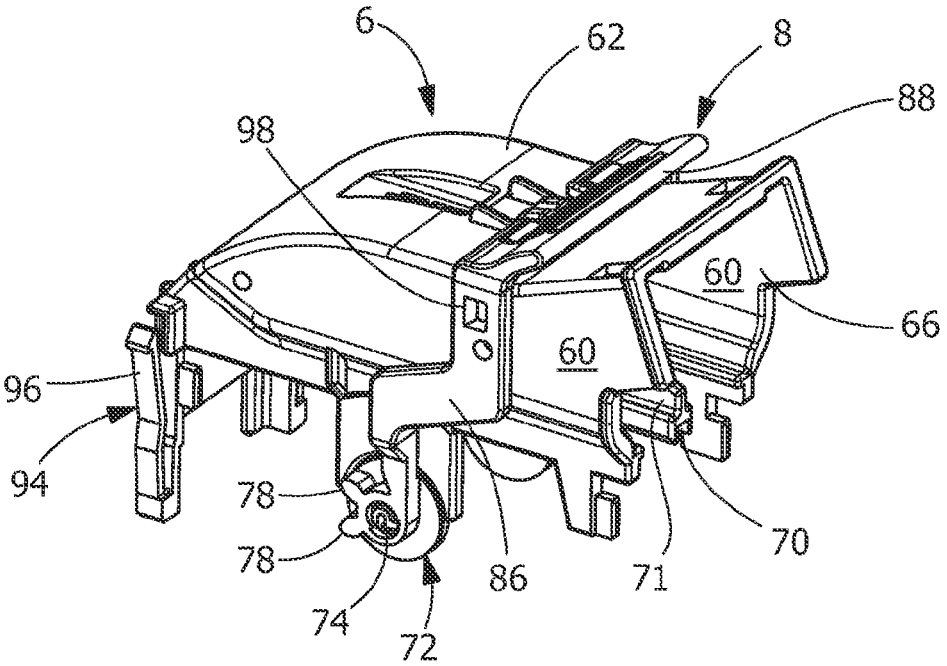
FIG. 9 is a perspective view of the cover of FIG. 8 with the lever shown in a mated position.

The cover 6, as best shown in FIGS. 8 and 9, has side walls 60 and a top wall 62 which extends between the side walls 60 to define a wire receiving cavity in which the wires terminated to the terminals 12 extend. An opening 66 is provided at an end of the cavity to allow the wires to extend from the connector assembly 2. If the cover 6 is mounted (as is more fully described below) to the housing 4 in a right opening orientation, the opening 66 would be positioned on the right side of the assembly 2, as viewed in FIG. 1. In contrast, if the cover 6 is mounted to the housing 4 in a left opening orientation, the opening 66 would be positioned on the left side of the assembly 2, as viewed in FIG. 1.

At least one slot 70 is provided on the end of a center wall 71 of the cover 6. The slot 70 is dimensioned to receive the rail 54 of the center wall 50 of the housing 4 therein and allow the cover 6 to be removably attached to the housing 4. In alternate embodiments, slots may also be provided on side walls 60. The slots can be dimensioned to receive rails 54 of the side walls 44 therein to further attach the cover 6 to the housing 4. The slots 70, which in the embodiment shown for a c-shaped tube like member, allow the cover 6 to be inserted onto the rails 54 of the housing 4 from either direction to allow for the left or right orientation. While slots 70 allow the cover 6 to be slid onto the rails 54, the c-shaped configuration of the slots 70 allows the walls of the slots 70 to surround and engaged the rails 54, thereby preventing the cover 6 from being removed from the housing 4 in a direction which is perpendicular to the longitudinal axis of the housing 4. The cover 6 can be positioned on the housing 4 in different orientations allowing the connector assembly to be assembled and used without the need to twist or distort wires which are terminated in the respective receptacle carriers 10.

A lever mounting member 72 extends from either side wall 60 of the cover 6 in a direction which is generally away from and generally perpendicular to the top wall 62. Posts 74 protrude from the members 72 away from the side walls 60 so that the lever 8 (FIGS. 8 and 9) can be mounted on the cover 6. It will of course be understood that only the post 74 on the front of the cover 6 is shown and that an equivalent post is also located on the rear of the cover, which cannot be seen in these three dimensional representative views.

As shown on FIGS. 8 and 9, the lever 8 is rotatably mounted on the posts 74 of the member 72 of the cover 6 such that the lever 8 may be rotated between an unmated position (FIG. 8) and a mated position (FIG. 9). The lever 8 includes pinion gears, such as, but not limited to mating teeth or member 78 located adjacent the fulcrum of the lever 8. As shown in FIG. 1, the mating teeth 78 engage rack gear members 82 on the pin header 14 which mates with the plug connector assembly 2.

In the embodiment shown in FIG. 8, the lever 8 is a single molded lever mounted on the cover 6. The lever includes two generally parallel lever arms 86 joined at one end by a handle or cross member 88. Each lever arm 86 includes a generally circular hub section 90 located at the free ends of the arms. An opening 92 is centrally located within this hub section 90, and each opening 92 is dimensioned to receive a respective post 74 (FIGS. 9 and 10) so that the lever 8 can be mounted on the cover 6. The teeth 78 extend from the hub section 90. Portions of the arms 86 adjacent to the handle or cross member 88 may be offset relative to the hub sections 90.

As shown in FIG. 1, the teeth 78 will engage the rack member 82 when the lever 8 is rotated in a clockwise direction to move the connector assembly 2 along a straight line into mating engagement with the pin header 14. The teeth 78 will engage the rack member 82 to unmate the connector assembly 2 from the pin header 14 when the lever 8 is rotated in a counter clockwise direction.

In FIG. 8, the lever 8 is positioned at the end of its counter clockwise travel relative to the cover 6 or in its fully unmated configuration. When the lever 8 is in this position, the connector assembly 2 can be partially inserted into the pin header 14 with terminals 12 in alignment with corresponding pins of the header. The lever 8 can be rotated in a clockwise direction from this position causing the teeth 78 to engage the mating rack gear members 82 to fully mate the connector assembly and the header.

Figure 6:
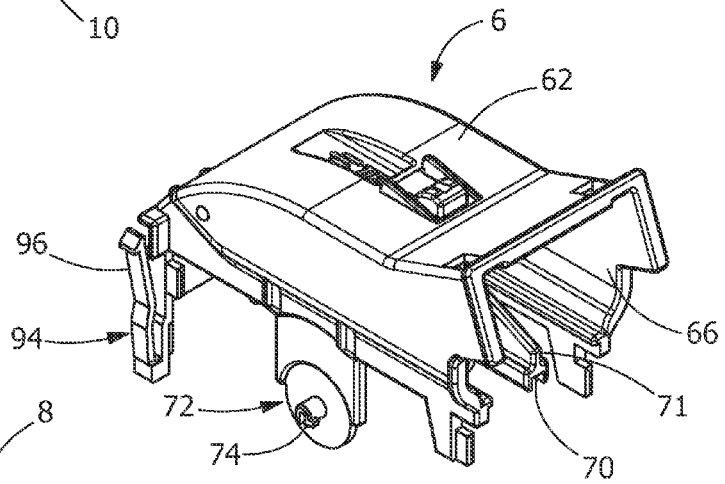
FIG. 6 is a perspective view of an exemplary cover of the connector assembly of FIG. 1, the cover does not have a lever positioned thereon.
Figure 7:
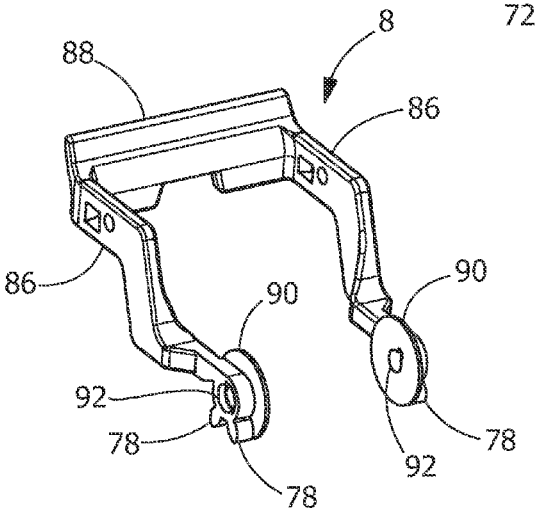
FIG. 7 is a perspective view of an exemplary lever of the connector assembly of FIG. 1.

As best shown in FIGS. 6, 8 and 9, an exemplary lever hold device 94 extends from at least one side wall 60 of the cover 6. The device 94 has a resilient arm 96. The resilient arm 96 comprises a latch end having a lock surface which cooperates with an opening 98 provided in the lever arms 86 to maintain the lever 8 in an unmated position. The force applied by the resilient arms 96 is designed to be overcome by an installer moving the lever 8 from the unmated position to the mated position. While the device 94 is shown extending from the side wall 60, other configurations are possible without departing from the scope of the invention. As best shown in FIGS. 1 and 2, the device 94 is provide proximate projections or posts 63 which extend from walls 44 of housing 4. The posts 63 are positioned proximate device 94 to provide additional support to the device 94 as the lever 8 is moved. The cooperation of posts 63 and device 94 also facilitate the proper positioning of the cover 6 on the housing 4.

When assembly 2 is mated with the mating connector 14, a portion of the mating connector will engage the resilient arm 96 of the device 94, causing the resilient arm 96 to be moved toward the wall 44 of the housing 4. This allows the latch end of the resilient arm 96 to be removed from the opening 98 to allow the lever 8 to be freely moved to the mated position.

A connector assembly according to the teaching herein has various advantages. The connector assembly is easy to assemble, as the receptacle carriers can be inserted from both sides of the housing. This eliminates the need for lengthy carriers with numerous wires terminated therein which may be difficult to properly dress. Additionally, as the cover can be positioned on the housing in different orientations, the connector assembly can be assembled and used without the need to twist or distort the wires which are terminated in the carrier and which extend from the connector assembly.

The positioning of the lever on the cover rather than on the housing also simplifies the mold cavities needed to make the already complicated housing. As the housing has various surfaces and projections provided therein, the removal of the mounting posts from the housing simplifies the housing, thereby simplifying the mold and providing better material flow in the mold. As the cover does not have the same molding complications, the positioning of the mounting posts on the cover provides for a connector assembly which is more repeatable and easier to manufacture.

Other advantages include, but are not limited to, the terminals are maintained in position with the assistance of the independent secondary locking shoulder or projections provided on the housing and the lever is maintained in the unmated condition by the lever hold down device until the lever is moved to the mated condition.

The representative embodiments of this invention are intended for use in automotive applications in which multiple wire harnesses are attached to a single component or to a single enclosure containing multiple components. A single integrated housing, which does not have carrier receptacles, could also be molded in accordance with the principles of this invention. While the exemplary embodiment discloses a connector assembly for mounting to a header, the connector assembly may be mounted to another type of connector, such as, but not limited to, a wire harness connector. Connectors incorporating this invention could also be used in other applications and are not limited to use in automobiles or motor vehicles.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A connector assembly comprising:

a housing having a connector mating face and a cover mating face, the housing having a first sidewall, an opposed second side wall, and a center wall provided between the first sidewall and the second sidewall;

a cover removably attached to the housing, the cover having a wire receiving cavity with an opening at the end of the cavity, a first receptacle carrier receiving cavity extending from respective openings on either side of the housing, the first cavity extending between the first sidewall and the center wall, a second receptacle carrier receiving cavity extending from the respective openings, the second cavity extending between the second sidewall and the center wall, wherein one or more receptacle carriers having terminal receiving cavities extending therethrough can be inserted into the first receptacle carrier receiving cavity through the respective openings on either side of the housing and one or more receptacle carriers having terminal receiving cavities extending therethrough can be inserted into the second receptacle carrier receiving cavity through the respective openings on either side of the housing;

wherein the cover can be positioned on the housing in different orientations.

2. The connector assembly as recited in claim 1, wherein the cover has a lever mounting member provided thereon.

3. The connector assembly as recited in claim 2, wherein a lever is rotatably mounted to the lever mounting member of the cover to allow the lever to be rotated between an unmated position and a mated position, wherein when the lever is rotated from the unmated position to the mated position, the connector assembly is moved a straight line into mating engagement with a mating pin header.

4. The connector assembly as recited in claim 1, wherein the the first receptacle carrier receiving cavity and the second receptacle carrier receiving cavity have projections which extend therein, the projections are received in grooves of the one or more receptacle carriers to provide a secondary locking for terminals positioned in the terminal receiving cavities of the one or more receptacle carriers.

5. The connector assembly as recited in claim 4, wherein the housing has resiliently deformable arms which cooperate with projections of the respective receptacle carriers to maintain the respective receptacle carriers in the first receptacle carrier receiving cavity and the second receptacle carrier receiving cavity the housing.

6. The connector assembly as recited in claim 1, wherein rails extend from the cover mating face of the housing, the rails are dimensioned to cooperate with slots of the cover to allow the cover to be slid relative to the housing wherein the cover may be mounted to the housing in different orientations and wherein the cover is prevented from being removed from the housing in a direction which is perpendicular to a longitudinal axis of the housing.

7. The connector assembly as recited in claim 3, wherein the lever mounting member has posts which protrude from the lever mounting member, the posts cooperate with openings provided in hubs of lever arms of the lever, wherein the lever may be rotated about the posts to allow the lever to be rotated between the unmated position and the mated position.

8. The connector assembly as recited in claim 3 wherein the cover has a lever hold device which cooperates with the lever to maintain the lever in the unmated position.

9. A connector assembly comprising:

a housing having receptacle carrier receiving cavities extending through respective openings on either side of the housing, the housing having a connector mating face and a cover mating face, a rail extending from the cover mating face of the housing;

receptacle carriers with terminals inserted therein positioned in the receptacle carrier receiving cavities, each terminal being terminated to a respective wire;

a cover extending from and being removably attached to the housing, the cover having a slot, the cover may be mounted to the housing in different orientations, the cover is prevented from being removed from the housing in a direction which is perpendicular to a longitudinal axis of the housing;

the rail is dimensioned to cooperate with the slot of the cover to allow the cover to be slid relative to the housing to allow the cover to be mounted to the housing in different orientations; and the receptacle carrier receiving cavities have projections which extend therein, the projections are received in grooves of the receptacle carriers to provide a secondary locking for the terminals.

10. The connector assembly as recited in claim 9, wherein the housing has resiliently deformable arms which cooperate with projections of the receptacle carriers to maintain the receptacle carriers in the housing.

11. The connector assembly as recited in claim 9, wherein a lever is rotatably mounted to a lever mounting member of the cover to allow the lever to be rotated between an unmated position and a mated position.

12. The connector assembly as recited in claim 11, wherein the lever mounting member has posts which protrude from the lever mounting member, the posts cooperate with openings provided in hubs of lever arms of the lever, wherein the lever may be rotated about the posts to allow the lever to be rotated between the unmated position and the mated position.

13. The connector assembly as recited in claim 11 wherein the lever includes pinion gears including a mating gear tooth and an unmating gear tooth located adjacent a fulcrum of the lever, wherein the gear teeth are configured to engage rack gear members on a mating pin header.

14. The connector assembly as recited in claim 11 wherein the cover has a lever hold device which cooperates with the lever to maintain the lever in the unmated position until a sufficient force is applied to move the lever to the mated position.

15. A cover for use with a connector assembly having a housing, the cover comprising:

a slot dimensioned to cooperate with a rail of the housing allowing the cover to be mounted to the housing in different orientations and preventing the cover from being removed from the housing in a direction which is perpendicular to a longitudinal axis of the cover;

a lever mounting member provided thereon; and a lever rotatably mounted to the lever mounting member to allow the lever to be rotated between an unmated position and a mated position; and wherein a lever hold device extends from at least one side wall of the cover, the device has a resilient arm with a latch end having a lock surface which cooperates with an opening provided in lever arms of the lever, the resilient arm maintains the lever in an unmated position.

16. The cover as recited in claim 15, wherein as the cover is mated with a mating connector, the resilient arm will be moved toward a wall of a housing on which the cover is installed, allowing the latch end of the resilient arm to be removed from the opening of the lever arm, thereby allowing the lever to be moved to the mated position.

17. The connector assembly as recited in claim 15, wherein the lever mounting member has posts which protrude from the lever mounting member, the posts cooperate with openings provided in hubs of lever arms of the lever, wherein the lever may be rotated about the posts to allow the lever to be rotated between the unmated position and the mated position.

* * * * *